US006412897B1

(12) United States Patent
Konishi et al.

(10) Patent No.: US 6,412,897 B1
(45) Date of Patent: Jul. 2, 2002

(54) IMAGE PRINTING METHOD AND DEVICE

(75) Inventors: Yoshiharu Konishi, Shiojiri; Hitoshi Hayama, Nagano-ken, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/520,740

(22) Filed: Mar. 7, 2000

(30) Foreign Application Priority Data

Mar. 9, 1999 (JP) ..... 11-061758

(51) Int. Cl.[7] ..... B41J 29/38; B41J 3/407
(52) U.S. Cl. ..... 347/14; 347/106
(58) Field of Search ..... 347/14, 17

(56) References Cited

U.S. PATENT DOCUMENTS 5,477,246 A * 12/1995 Hirabayashi et al. ..... 347/12
5,524,993 A * 6/1996 Durst ..... 400/279
5,617,516 A * 4/1997 Barton ..... 395/113
5,790,150 A * 8/1998 Lidke et al. ..... 347/41
6,092,946 A * 7/2000 Cockerill et al. ..... 400/613
6,132,021 A * 10/2000 Smith et al. ..... 347/6
6,158,909 A * 12/2000 McCrue et al. ..... 400/582
6,189,993 B1 * 2/2001 Mantell ..... 347/15
6,191,866 B1 * 2/2001 Kim ..... 358/1.2

FOREIGN PATENT DOCUMENTS

JP 6-239013 8/1994 ..... B41M/5/00
JP 7-047695 2/1995 ..... B41J/2/18

* cited by examiner

*Primary Examiner*—John Barlow
*Assistant Examiner*—Alfred Dudding
(74) *Attorney, Agent, or Firm*—Hogan & Hartson, L.L.P.

(57) ABSTRACT

There is provided an image printing method and device which is capable of maintaining quality of a print image printed on a printing object by using ink even when the penetration rate of ink into the printing object varies. Factors are detected which cause a change in the penetration rate of at least one kind of ink into the printing object. Printing control conditions are set in dependence on results of detection of the factors causing the change in the penetration rate. The print image is printed on the printing object by using the at least one kind of ink based on print image data representative of the print image and the printing control conditions.

34 Claims, 6 Drawing Sheets

IMAGE PRINTING METHOD AND DEVICE

BACKGROUND OF THE INVENTION

1. Field of the Invention

This invention relates to an image printing method and device for printing a print image on a printing object by using an ink.

2. Prior Art

Conventionally, the method of printing a print image by using an ink includes a dot impact method and a thermal method which use a ribbon containing ink or the like, as well as an ink jet printing method in which ink droplets are ejected. In the ink jet printing method, for instance, printing is carried out by blowing (ejecting) ink droplets corresponding to dots of a desired print image onto a printing object from nozzles of an ink jet head (print head). When the print image is a color image, inks of three primary colors of C (cyan), M (magenta), and Y (yellow), or four basic colors of the three primary colors plus K (black) are ejected to corresponding dots of a print image according to a desired print color of the print image, to thereby carry out color printing.

The image printing method of the above-described kind which uses inks, particularly, the ink jet printing method, suffers from a problem of degradation of quality of a printed image due to mixing of adjacent printed dots through blotting of ink on the printing object or on the contrary due to increased space between printed dots caused by limited spreading of ink on the printing object. That is, even if ink is ejected to the center of each print dot, the size and density of the printed dot varies with the degree of permeation of ink into the printing object (hereinafter referred to as "penetration rate"), which can prevent a print image having a desired quality from being obtained even if printing control conditions, such as a print density (reciprocal of a distance between centers of adjacent print dots), are set to predetermined suitable conditions.

SUMMARY OF THE INVENTION

It is an object of the invention to provide an image printing method and device which is capable of maintaining quality of a print image printed on a printing object by using ink even when the penetration rate of ink into the printing object has changed.

To attain the above object, according to a first aspect of the invention, there is provided a method of printing a print image on a printing object by using ink, comprising the steps of:

detecting factors causing a change in a penetration rate of at least one kind of ink into the printing object;

setting printing control conditions in dependence on results of detection of the factors causing the change in the penetration rate; and printing the print image on the printing object by using the at least one kind of ink based on print image data representative of the print image and the printing control conditions.

To attain the above object, according to a second aspect of the invention, there is provided an image printing device comprising:

a penetration rate-changing factor-detecting section for detecting factors causing a change in a penetration rate of at least one kind of ink into a printing object;

a printing control condition-setting section for setting printing control conditions in dependence on results of detection of the factors causing the change in the penetration rate; and an image printing section for printing the print image on the printing object by using the at least one kind of ink based on print image data representative of the print image and the printing control conditions.

According to the image printing method and device, factors causing a change in a penetration rate of at least one kind of ink into a printing object are detected, and printing control conditions are set in dependence on results of detection of the factors causing the change in the penetration rate. The print image is printed on the printing object by using the at least one kind of ink based on print image data representative of the print image and the printing control conditions. That is, by detecting the factors causing the change in the penetration rate of ink, a change of the penetration can be expected, and the printing control conditions are set according to the results of detection of the factors causing the change. Therefore, it is possible to set suitable printing control conditions according to the change in the penetration rate, and the print image is printed based on the printing control conditions thus set. Therefore, even if the penetration rate of the ink into the printing object has changed, it is possible to maintain the quality of a print image printed on the printing object by using the ink.

Preferably, the printing control conditions include a print density which is inversely proportional to a distance between centers of adjacent print dots of the print image.

As described hereinbefore, if the penetration rate of the ink into the printing object has changed, the quality of the print image can be degraded due to mixing of adjacent printed dots or on the contrary due to increased space between printed dots caused by limited spreading of ink on the printing object. According to the preferred embodiment of each aspect of the invention, the printing control conditions based on which printing is controlled include a print density which is inversely proportional to a distance between centers of adjacent print dots of the print image, and hence it is possible to set the print density according to the change in the penetration rate of ink into the printing object, whereby even if the penetration rate of ink into the printing object has changed, the quality of a print image printed by using the ink can be maintained.

Preferably, the step of printing the print image includes printing the print image while causing relative movement of at least one of a print head that ejects droplets of the ink and the printing object relative to each other, and the printing control conditions include a speed of the relative movement.

Preferably, the image printing section includes a print head that ejects droplets of the ink, and a relative movement section for causing relative movement of at least one of the print head and the printing object relative to each other, and the printing control conditions include a speed of the relative movement.

Generally, if a time period (drying time) which ink of print dots takes to become dry changes, the penetration rate changes at which the ink penetrates into a printing object before the ink becomes dry. If the penetration rate changes, the size of the print dot also changes. Therefore, when the penetration rate of ink into a printing object has changed, if a time period or a time interval from a printing operation for printing an arbitrary print dot to a printing operation for printing a print dot adjacent thereto is uniformly set to a predetermined value, that is, if the printing speed is uniformly set to a predetermined value, print dots adjacent to each other in the direction of printing (direction of relative movement) can be mixed with each other, thereby degrading the quality of a print image. Inversely, if unnecessarily long drying time is secured, the printing speed is unnecessarily lowered.

According to the preferred embodiment of each aspect of the invention, the print image is printed by moving at least one of the print head for ejecting droplets of ink onto the printing object and the printing object relative to each other, and the printing control conditions thereof include the speed of the relative movement. Therefore, it is possible to set the speed of the relative movement as a printing control condition according to the change in the penetration rate, thereby making it possible to change the printing speed. As a result, it is possible to set a printing speed at which a minimum drying time may be secured for maintaining the quality of the print image. Therefore, even if the penetration rate of ink into the tape (printing object) has changed, the quality of a print image printed by using the ink can be maintained. Further, since the print image can be printed at a suitable printing speed in manner varying with the change in the penetration rate, it is possible to prevent an undesired decrease in the printing speed (increase in the printing time).

Preferably, the step of printing the print image includes the steps of feeding the printing object by a unit distance dependent on a slippage of the printing object in response to each pulse of a predetermined unit feed signal, and carrying out printing on the printing object being fed, and the printing control conditions include the number of pulses of the predetermined unit feed signal generated per unit time period.

Preferably, the image printing section includes a signal generating section that generates a predetermined unit feed signal, a printing object feeding section that feeds the printing object by a unit distance dependent on a slippage of the printing object in response to each pulse of the predetermined unit feed signal, and a printing executing section for carrying out printing of the print image on the printing object being fed, and the printing control conditions include the number of pulses of the predetermined unit feed signal generated per unit time period.

According to these preferred embodiments, the printing object is fed by a unit distance dependent on a slippage of the printing object in response to each pulse of a predetermined unit feed signal, and printing is carried out on the printing object being fed. The printing control conditions include the number of pulses of the predetermined unit feed signal generated per unit time period. As described above, the penetration rate of ink changes with the drying time of ink, and the change in the penetration rate changes the size of each print dot. Therefore, when the penetration rate of ink into a printing object has changed, if the printing speed is uniformly set to a predetermined value, print dots adjacent to each other in the direction of printing (direction of feed) can be mixed with each other, thereby degrading the quality of a print image. Inversely, if an unnecessarily long drying time is secured, the printing speed is unnecessarily lowered. To eliminate these inconveniences, it is required to change the printing speed according to the change in the penetration rate.

Generally, slippage of a printing object depends on the printing object. When the printing object is fed in response to each pulse of a unit feed signal by a unit distance dependent on the slippage of the printing object, if it is desired to feed the object at a predetermined printing speed, it is required to output a corresponding number of pulses of the unit feed signal adapted to the slippage of the printing object. Inversely, it is possible to change the printing speed by changing the number of pulses of the unit feed signal. Therefore, in the preferred embodiment of each aspect of the invention, the printing control conditions include the number of pulses of the predetermined unit feed signal, so that it is possible to set the number of pulses of the unit feed signal according to the change in the penetration rate of ink as one of the printing control conditions to thereby change the printing speed. This makes it possible to carry out printing at the printing speed responsive to the change in the penetration rate. Therefore, even if the penetration rate of ink into the tape (printing object) has changed, the minimum drying time required for maintaining the quality of a print image can be secured, thereby maintaining the quality of the print image printed by using the ink can be maintained, and it is also possible to prevent an undesired decrease in the printing speed (increase in the printing time).

Preferably, the printing control conditions include a gradation value of each pixel of the print image.

According to this preferred embodiment of each aspect of the invention, the printing control conditions include a gradation value of each pixel of the print image. That is, a gradation value which designates a shading or gray level of each pixel of a monochrome image or a color shade of each pixel of a color image can be set as one of the printing control conditions, and hence it is possible to set the gradation value of each pixel in dependence on the change in the penetration rate. This makes it possible to maintain the quality of a print image printed by using ink, even if the penetration rate of the ink into the printing object has changed.

More preferably, the print image is a color image, and the gradation value comprises a plurality of basic color gradation values corresponding to respective basic colors, the at least one kind of ink including inks for printing the plurality of basic colors as respective print colors.

In general, the color shading (color) of each pixel of a color image can be represented by basic gradation values corresponding to a plurality of basic colors into which the color can be decomposed. According to the preferred embodiment of each aspect of the invention, the print image is a color image, and the gradation value comprises a plurality of basic color gradation values corresponding to respective basic colors, the at least one kind of ink including inks for printing the plurality of basic colors as respective print colors. Therefore, by carrying out printing by using inks having the basic colors as printing colors according to the respective basic color gradation values, the print image as a color image can be printed.

More preferably, the plurality of basic colors include three primary colors.

According to this preferred embodiment of each aspect of the invention, the plurality of basic colors include three primary colors. Therefore, the color shading of each pixel of the color image can be represented by decomposing the color of each pixel into the basic color (primary color) gradation values. Further, in this case, the at least one kind of ink includes inks for printing the three primary colors as printing colors. Therefore, by using these inks according to the respective basic color gradation values, it is possible to print the print image as a color image. It should be noted that as the three primary colors, there are normally used C (cyan), M (magenta), and Y (yellow), and various colors are represented by the subtractive color mixing method.

Further preferably, the plurality of basic colors further include a basic color corresponding to a mixed color of the three primary colors.

According to this preferred embodiment of each aspect of the invention, the plurality of basic colors include a basic color corresponding to a mixed color of the three primary colors. Therefore, the inks used further include an ink of the basic color corresponding to the mixed color of the three primary colors. For instance, although mixture of the three primary colors of C (cyan), M (magenta), and Y (yellow) provides K (black), a more beautiful black can be obtained by using an ink of K (black) than by actually mixing the primary colors, and hence the preferred embodiment of each aspect of the invention makes it possible to print a beautiful print image by using the four (basic) colors.

Preferably, the method further includes the step of designating a printing mode out of at least two of an image quality-preference mode for printing the print image with a higher image quality, a printing speed-preference mode for printing the print image with a faster printing speed, and an optimal print mode for printing the print image with a moderate image quality and a moderate printing speed, and the step of setting printing control conditions includes setting the printing control conditions according to the designated printing mode, in dependence on results of detection of the factors causing the change in the penetration rate.

Preferably, the image printing device further includes a printing mode-designating section for designating a printing mode out of at least two of an image quality-preference mode for printing the print image with a higher image quality, a printing speed-preference mode for printing the print image with a faster printing speed, and an optimal print mode for printing the print image with a moderate image quality and a moderate printing speed, and the printing control condition-setting section sets the printing control conditions according to the designated printing mode, in dependence on results of detection of the factors causing the change in the penetration rate.

Depending on penetration rate of ink into the printing object, if further drying of ink is awaited after completion of printing of desired print dots at the cost of a printing speed and then adjacent print dots are printed, it is sometimes possible to improve the quality of a printed image, e.g. by increasing the print density. Inversely, there can be a case where a print image is desired to be printed as fast as possible on condition that the minimum quality of the print image is maintained. In the preferred embodiment of each aspect of the invention, a printing mode is designated out of at least two of an image quality-preference mode for printing the print image with a higher image quality, a printing speed-preference mode for printing the print image with a faster printing speed, and an optimal print mode for printing the print image with a moderate image quality and a moderate printing speed, and the printing control conditions are set according to the designated printing mode, in dependence on results of detection of the factors causing the change in the penetration rate. Therefore, the image quality and the printing speed can be enhanced to respective allowable extents dependent on the user's selection of the mode, which makes it easy to print a print image of desired quality at a desired speed, thereby increasing the operability and capability of the apparatus in image printing. It should be noted that the optimum printing mode is a mode in which printing control conditions are set which make moderate both the image quality and the printing speed, which may be default settings or the most frequently used ones of the printing control conditions. Further, the image quality-preference mode includes a mode in which the print image having the highest quality is set within an allowable range, and similarly, the printing speed-preference mode includes a mode in which the highest printing speed is set within an allowable range which permits the minimum quality of print images to be maintained.

Preferably, the factors causing the change in the penetration rate include a type of the printing object.

As described above, even if each ink droplet is ejected to the center of a corresponding print dot, the size and density of each print dot depend on the degree of penetration (penetration rate) of ink into the printing object, so that a printed image is sometimes prevented from having a desired image quality, even if printing control conditions, such as a print density and the like, are set to predetermined setting values. In the preferred embodiment of each aspect of the invention, the factors causing the change in the penetration rate include a type of the printing object. That is, the type of the printing object is detected as one of the factors causing the change in the penetration rate, and hence it is possible to discriminate between different penetration rates dependent on the type of the printing object. When the penetration rate has changed from a value initially set or a value set the last time, the change in the penetration rate can be detected. This make sit possible to set printing control conditions, such as a print density and the like, according to the change in the penetration rate, whereby the quality of a print image printed by using ink can be maintained, even if the penetration rate has changed.

Preferably, the type of the printing object includes a material of the printing object.

Generally, if printing objects are different in material, the penetration rate of ink is different between the printing objects, even if the ink itself is identical. In the preferred embodiment of each aspect of the invention, since the type of the printing object includes a material of the printing object, and the change in the penetration rate due to a difference in the material of the printing object can be detected, printing control conditions, such as a print density and the like, can be set according to the change in the penetration rate.

Preferably, the type of the printing object includes a size of the printing object.

In general, if printing objects are different in size from each other, a print unit to be printed on one printing object, such as one dot line of print dots and the like, takes a different printing time from a print unit to be printed on another printing object, so that the drying time which ejected ink takes to become dry can vary with the printing object, that is, depending on the difference in time elapsed between printing of a print unit (line of print dots) and printing of the following print unit(line of print dots) on each printing object. This sometimes changes the penetration rate before the ink becomes dry. This also can change the print density and the printing speed which enable a print image to be printed with the quality thereof being maintained. In the preferred embodiment of each aspect of the invention, the type of the printing object includes a size of the printing object. Hence, it is possible to detect the change in the penetration rate at which ink penetrates into the printing object before the ink becomes dry. This makes it possible to set printing control conditions, such as a print density, according to the change in the penetration rate.

Preferably, the factors causing the change in the penetration rate include at least one of ambient temperature and ambient humidity.

In general, if the ambient temperature has changed, the drying time of ink also changes, which can change the penetration rate at which the ink penetrates into the tape before the ink becomes dry. In the preferred embodiment of each aspect of the invention, the factors causing the change in the penetration rate include at least one of ambient temperature and ambient humidity. That is, at least one of the ambient temperature and the ambient humidity is detected, so that it is possible to determine the difference in the penetration rate of ink into the printing object, which is caused by the difference in the detected ambient temperature and/or the ambient humidity, and thereby detect the change in the penetration rate. This makes it possible to set printing control conditions, such as a print density according to the change in the penetration rate. As a result, even if the penetration rate of ink into the printing object has changed, the quality of a print image printed by using the ink can be maintained.

Preferably, the factors causing the change in the penetration rate include the number of print dots existing in a predetermined unit printing area on which printing has already been carried out.

If the number of print dots existing in a predetermined unit print area varies, the drying time of ink also varies even if the ink is identical, which can change the penetration rate at which the ink penetrates into the printing object before the ink becomes dry. In the preferred embodiment of each aspect of the invention, the factors causing the change in the penetration rate include the number of dots existing in a predetermined unit printing area on which printing has already been carried out (cumulative number of print dots), whereby the change in the penetration rate of ink in use can be detected. This makes it possible to set printing control conditions, such as a print density, according to the change in the penetration rate. As a result, even if the penetration rate of ink into the printing object has changed, the quality of a print image printed by using the ink can be maintained.

Preferably, the factors causing the change in the penetration rate include a condition of whether a transparent laminating material is laminated onto the printing object, and the method includes the steps of determining whether the transparent laminating material is to be laminated onto the printing object, and laminating the transparent laminating material onto the printing object such that the transparent laminating material covers the print image printed on the printing object, when it is determined that the transparent laminating material is to be laminated onto the printing object.

Preferably, the factors causing the change in the penetration rate include a condition of whether a transparent laminating material is laminated onto the printing object, and the image printing device includes a lamination-determining section for determining whether the transparent laminating material is to be laminated onto the printing object, and a laminating section for laminating the transparent laminating material onto the printing object such that the transparent laminating material covers the print image printed on the printing object, when it is determined that the transparent laminating material is to be laminated onto the printing object.

Generally, when a printed image is laminated with a laminating material, the image is protected by the lamination. On the other hand, since ink is made far more difficult to become dry than before the lamination, the drying time of the ink changes, whereby the penetration rate at which the ink penetrates into the printing object before the ink becomes dry can be changed. This also can change an appropriate print density and an appropriate printing speed which permits a print image to be printed while preserving the quality thereof. Further, when an image printed by using the ink is laminated before the ink becomes dry, the ink can be exuded and adversely affect the following print image by changing the penetration rate and adhering to a laminating device or mechanism, so that it is required to laminate the printed image when the ink is sufficiently dry after being ejected for printing.

In the preferred embodiment of each aspect of the invention, the factors causing the change in penetration rate include a condition of whether or not a printing object is to be laminated with a transparent laminating material. When it is detected that the lamination is to be executed, the printing object is laminated with a transparent laminating material such that the laminating material covers an image printed on the printing object. That is, it is possible to determine the difference in the penetration rate of ink into the printing object, which depends on whether or not the lamination is executed, and thereby detect the change in the penetration rate. Accordingly,i tis possible to set printing control conditions, such as a print density and a printing speed. As a result, even when the penetration rate of ink into the printing object has changed, the quality of a print image printed by using the ink can be maintained. It should be noted that when the execution or no-execution of the lamination corresponds to a type of the printing object, detection of whether or not the lamination is to be carried out may be effected as part of detection of the type of the printing object. Alternatively, if the lamination can be effected on an arbitrary printing object, the apparatus may be configured such that the user can set whether or not the lamination is executed and results of the settings are detected.

Preferably, the printing object is a tape.

In this preferred embodiment of each aspect of the invention, since the printing object is a tape, the invention can be applied to a tape printing apparatus.

Preferably, the print image is printed by an ink jet printing method.

In this preferred embodiment of each aspect of the invention, since the print image is printed by an ink jet printing method, the invention can be applied to a printing apparatus based on the ink jet printing method.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof. In the embodiment, an image printing method and device according to the invention is applied to a tape printing apparatus.

Figure 1:
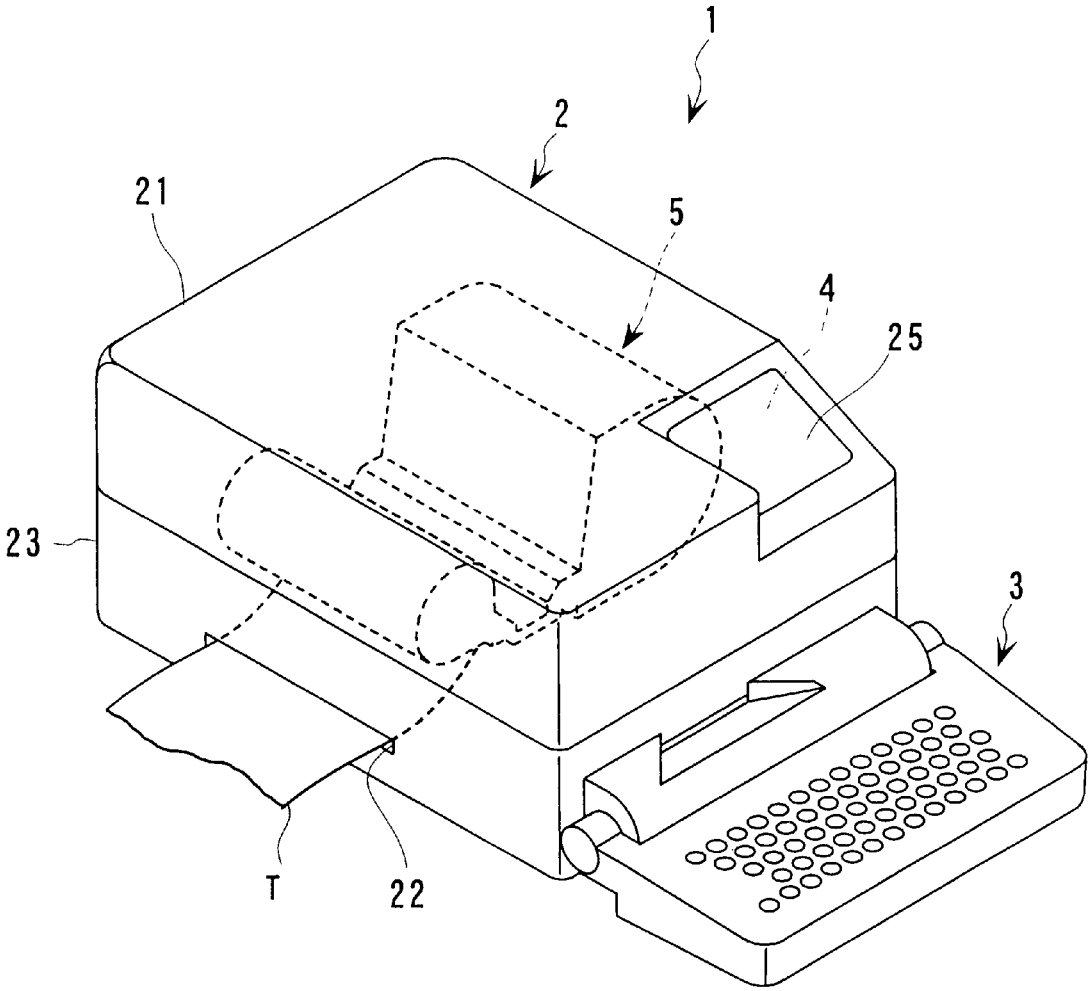
FIG. 1 is a perspective view of an appearance of a tape printing apparatus to which is applied an image printing method and device according to an embodiment of the invention.
Figure 2:
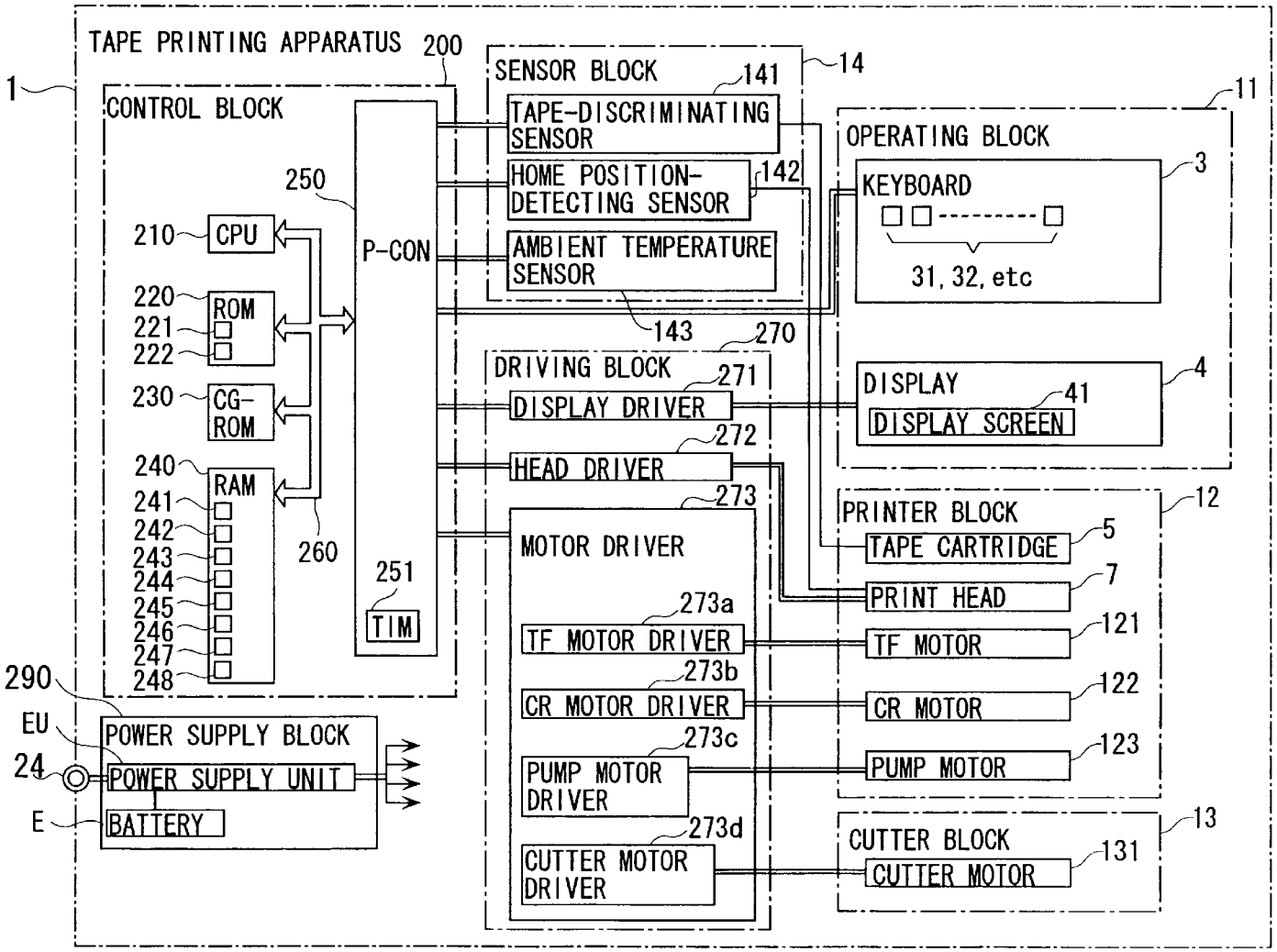
FIG. 2 is a block diagram of a control system of the FIG. 1 tape printing apparatus.

FIG. 1 is a perspective view of an appearance of the tape printing apparatus, and FIG. 2 is a block diagram of the control system of the apparatus.

The tape printing apparatus 1 is capable of carrying out color printing of a print image entered via a keyboard thereof on a printing tape T1 by an ink jet printing method as well as cutting off the printed portion or strip of the printing tape T1 to thereby produce a label. Further, when not only a printing tape T1 but also a laminating tape T2 (see FIGS. 3 and 4) is mounted in this tape printing apparatus 1, the apparatus 1 is also capable of laminating the laminating tape T2 to the printed portion of the printing tape T1 and cutting off, the printing tape T1 laminated with the laminating tape T2 to thereby form a laminated label. Hereinafter, a type formed of the printing tape T1 alone and a type formed of both the printing tape T1 and the laminating tape T2 will be generically referred to as "the tape T".

The printing tape T1 is comprised of a substrate tape, an adhesive layer coated on an underside surface of the substrate tape, and a peel-off paper tape affixed to the adhesive layer. The substrate tape is formed of a material which is capable of readily absorbing ink, such as paper, paper with a coated layer, or a film with a coated layer. The adhesive layer is used for affixing the printing tape T1 as a label to an object article, such as a file and the like, while the peel-off paper tape is used for preventing dust or dirt from depositing on the adhesive layer.

On the other hand, the laminating tape T2 is comprised of a substrate tape and an adhesive layer coated on an underside surface of the substrate tape. The substrate tape is formed of a transparent film having a thickness of approximately 16 to 38 $\mu$m. The printing tape T1 and the laminating tape T2 are fabricated to have an approximately identical width and affixed to each other in a manner such that lateral sides thereof are aligned one upon the other. Actually, the laminating tape T2 has a slightly smaller width (by approximately 0.3 mm) than the printing tape T1 such that slight lateral displacement of the laminating tape T2 can be accommodated when the same is affixed to the printing tape T1.

There are provided several kinds (approximately 10 kinds) of tape T having various tape widths (approximately 4.5 to 96 mm), each of which is supplied in a state received in a tape cartridge 5 therefor. A print image having a resolution of 24 to 1024 dots in the direction of the width thereof is printed on the printing tape T, dependent on the width thereof. It should be noted that there are provided still other tapes T which are different in material or have background colors other than white and that it is possible to use at least several tens of kinds of tape T including ones to be adopted in-the future. The tape cartridges 5 are classified into a type which can contain both a printing tape T1 and a laminating tape T2 (see FIG. 4) and a type which can contain only a printing tape T1. Each of the two types includes three kinds of tape cartridges i.e. "large, "medium" and "small" cartridges, which are different in height, i.e. width of tapes contained.

Referring first to FIG. 1, the tape printing apparatus 1 is comprised of a body 2, a keyboard 3 mounted on a front-side portion of the body 2, a tape cartridge 5 accommodating the tape T (the printing tape T1 and the laminating tape T2) and an ink cartridge 8 (see FIG. 3) containing inks of four colors. The tape cartridge 5 and the ink cartridge 8 are removably mounted in the body 2. The body 2 includes an apparatus casing 23. The upper part of the apparatus casing 23 is in the form of a lid 21 which can be opened and closed for mounting and removing the tape cartridge 5 and the ink cartridge 8. The apparatus casing 23 has aside wall formed with a tape exit 22 in the form of a slit via which the tape T is dispensed out of the apparatus 1.

The keyboard 3 is hinged on a lower portion of a front surface of the body 2 of the tape printing apparatus 1 such that it can be brought either to an upright position or to a horizontal position for use with the body 2. The keyboard 3 is brought to the horizontal position when the apparatus 1 is in use, while it is held in the upright or folded position to cover the front surface of the apparatus 1 when the apparatus 1 is carried by a user. The lid 21 has a small window 25 formed in a right-side front portion thereof in a manner corresponding to a display 4 arranged within the body 2. The keyboard 3 and the display 4 will be described in detail hereinafter.

Further, as shown in FIG. 2, the tape printing apparatus 1 is comprised of an operating block 11 basically including the keyboard 3 and the display 4 for interfacing between the user and the apparatus 1, a printer block 12 including an ink jet print head 7 for printing on the tape T (printing tape T1) unwound from the tape cartridge 5, a cutter block 13 for cutting off the tape T after printing, a sensor block 14 including various sensors for carrying out various kinds of detection, a driving block 270 including various drivers for driving circuits of respective blocks, a power supply block 290, and a control block 200 for controlling the respective blocks within the tape printing apparatus 1.

Therefore, the apparatus casing 23 accommodates not only the printer block 12, the cutter block 13, and the sensor block 14, but also a circuit board, not shown, on which are mounted a circuit of the power supply block 290 as well as circuits of the driving block 270 and the control block 200. The power supply block 290 has a power supply unit EU connected to an AC adapter port 24, or a battery E, such as a nicad battery, which can be mounted and removed from outside. The power supply unit EU supplies power to the electric components of the tape printing apparatus 1.

Figure 3:
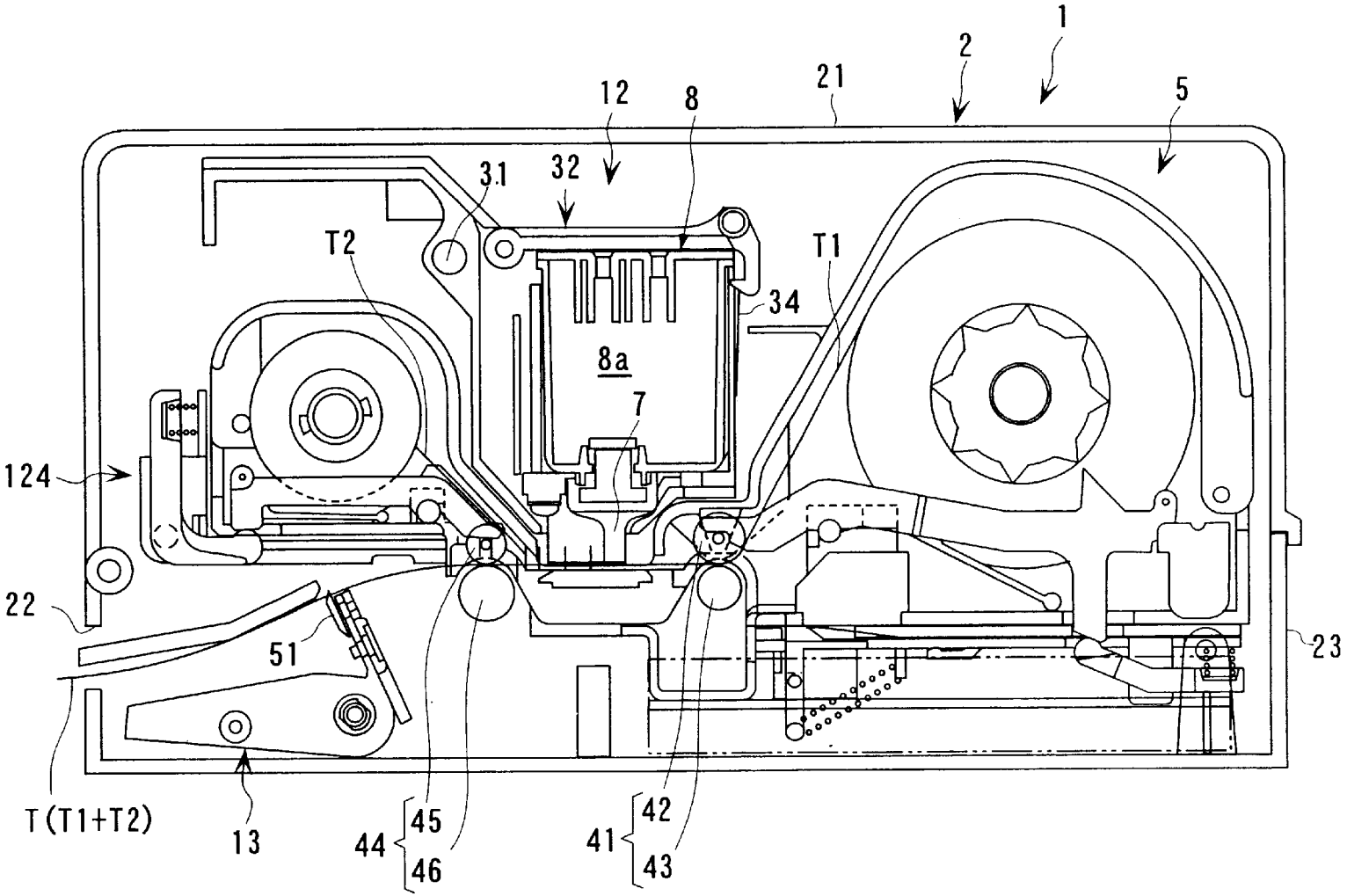
FIG. 3 is a cross-sectional view of a body of the FIG. 1 tape printing apparatus.

FIG. 3 shows the body 2 of the tape printing apparatus 1 in cross section. As shown in FIGS. 2 and 3, the printer block 12 includes a carriage guide shaft 31 having opposite ends thereof supported by a frame, not shown, a carriage 32 slidably mounted on the carriage guide shaft 31, a timing belt, not shown, traveling in normal and reverse directions for reciprocating the carriage 32 transversely to the direction of feed of the tape T (in the direction of the width of the tape T), a carriage motor (CR motor) 122 for causing the timing belt to travel in the normal and reverse directions, feed roller means 41 comprised of a feed driven roller 42 positioned above and a feed drive roller 43 positioned below, laminating roller means 44 comprised of a laminating driven roller 45 positioned above and a laminating drive roller 46 positioned below, a tape feed motor (TF motor) 121 for driving the feed drive roller 43 and the laminating drive roller 46 for rotation via a reduction gear train, not shown, a head cap mechanism, not shown, for closing ink nozzles of the print head 7 and cleaning the same by using a pump motor 123 as required, and an ejection mechanism 124 for setting and ejecting the tape cartridge 5.

The print head 7 for printing on the tape T and a cartridge holder 34 for holding the ink cartridge 8 that supplies ink are mounted at lower and upper portions of the carriage 32, respectively, in a manner forming a unit. The print head 7 faces downward, and the ink cartridge 8 is mounted within the cartridge holder 34 such that it has its delivery port directed downward. When the ink cartridge 8 is mounted, ink reservoirs 8a thereof, each of which contains ink of a different color, communicates with the print head 7 for supply of ink. The ink reservoirs 8a contain C (cyan) ink, M (magenta) ink, Y (yellow) ink, and K (black) ink, respectively.

Further, the carriage 32 has light shields, not shown, projecting therefrom. When one of the light shields is brought before an associated one of position-detecting sensors 142 each comprised of a photo interrupter or the like, the print head 7 is detected to be at a home position, not shown, whereby the correction of the position of the print head 7, such as zero position adjustment, is carried out. The home position serves not only as a stand by position of the print head 7 but also as a reference position for printing. The CR motor 122 is driven for rotation in a predetermined number of steps from the reference position, whereby the carriage 32 is moved with accuracy to each position in the direction of the width of the tape T within a printing range, and the print head 7 is driven in synchronism with movement of the carriage 32 to thereby effect printing on a surface of the tape T in a desired manner.

Figure 4:
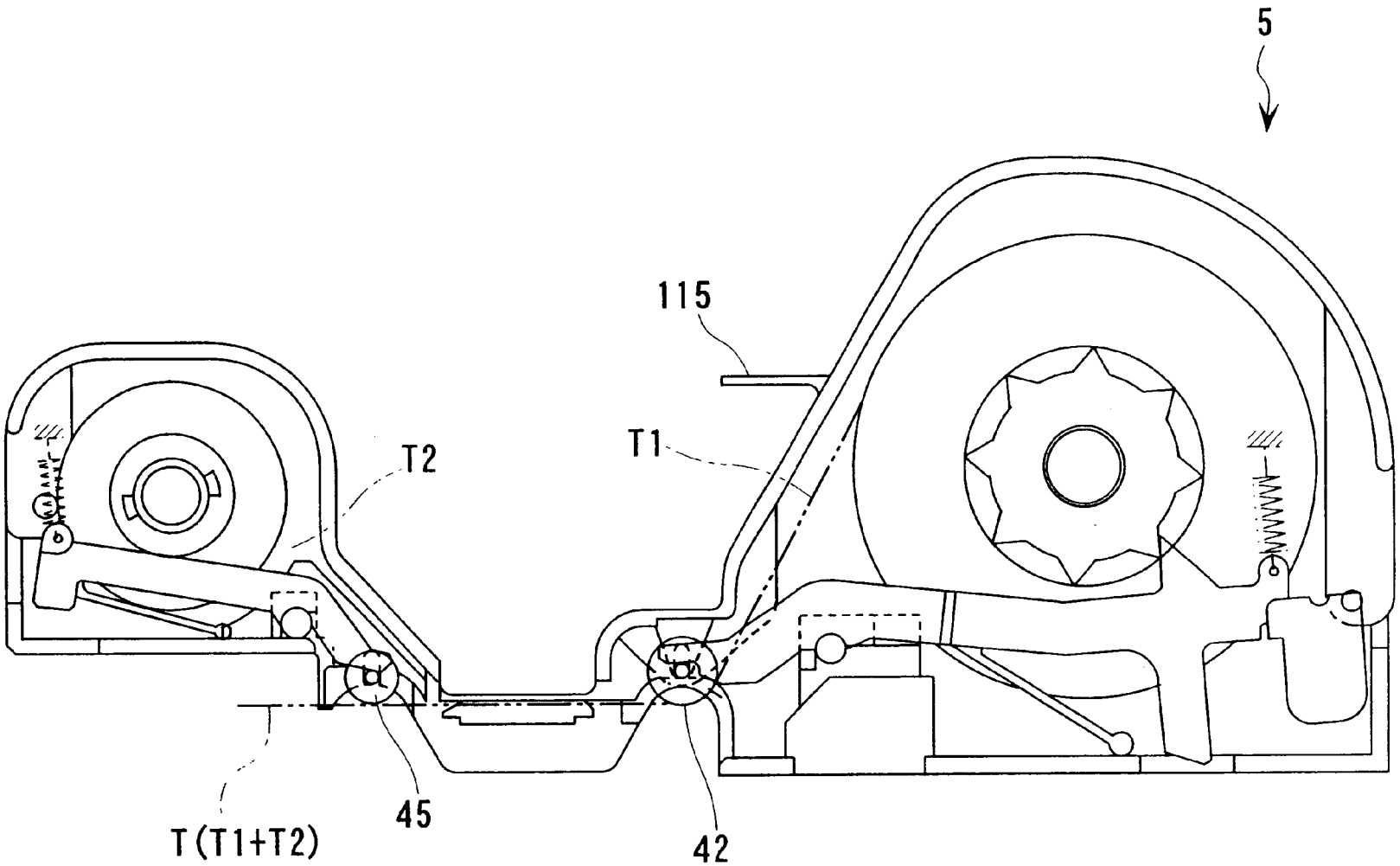
FIG. 4 is a cross-sectional view of a tape cartridge for being mounted in the FIG. 1 tape printing apparatus.

The tape cartridge 5 is provided with a discriminating plate 115 bearing discriminating information based on bit patterns or the like (see FIG. 4). A tape-discriminating sensor 141 mounted on the carriage 32 is brought to the discriminating plate 115 to thereby discriminate the type or kind of each of the tape cartridge 5, the printing tape T1 and the laminating tape T2 as well as detect a print-starting position for starting a printing operation on each printing tape T1. Hereinafter, a signal indicative of results of the sensing is referred to as the tape-discriminating signal.

The feed drive roller 43 is arranged in the body 2 of the tape printing apparatus 1, while the feed driven roller 42 is arranged in the tape cartridge 5. When the tape cartridge 5 is mounted in the body 2, the feed driven roller 42 presses the printing tape T1 in a manner sandwiching the tape T1 between the feed drive roller 43 and the feed driven roller 42 itself. The printing tape T1 is advanced in this state as the TF motor 121 rotates.

The laminating drive roller 46 is arranged in the body 2, while the laminating driven roller 45 is arranged in the tape cartridge 5. When the tape cartridge 5 is mounted in the body 2, the laminating driven roller 45 presses the printing tape T1 and the laminating tape T2 in a manner sandwiching the same between the laminating drive roller 46 and the laminating driven roller 45 itself. The printing tape T1 and the laminating tape T2 are advanced in this state while being affixed to each other as the TF motor 121 rotates.

The cutter block 13 includes a cutter 51 and a cutter motor 131 for driving the cutter 51 for cutting operation. After printing is completed, the tape T (the printing tape T1+the laminating tape T2) is stopped when the TF motor 121 feeds the same further by a predetermined number of steps, and at the same time, the cutter motor 131 starts driving the cutter 51 for cutting the tape T. It should be noted that in the tape printing apparatus 1, a cutting key, not shown, is provided so that the cutting operation can be manually carried out by key stroke, and it is possible to selectively set one of an automatic cutting mode and a manual cutting mode.

As shown in FIG. 2, the sensor block 14 is comprised of not only the tape-discriminating sensor 141 and the home position-detecting sensor 142, described above, but also an ambient temperature sensor 143. As described above, the tape-discriminating sensor 141 not only discriminates the type or kind of each of the tape cartridge 5, the printing tape T1, etc. but also detects the print-starting position for starting a printing operation on each printing tape T1, while the home position-detecting sensor 142 detects that the print head 7 is at its home position. The two sensors 141 and 142 deliver respective signals (tape-discriminating signal and position-detecting signal) to the control block 200. Similarly, the ambient temperature sensor 143 detects an ambient temperature as one of parameters of a printing environment and delivers a signal (temperature-detecting signal) to the control block 200. It should be noted that it is possible to provide other sensors as well, such as a voltage sensor to be connected to the power supply unit EU of the power supply block 290 supplying power to each of the electric components in the tape printing apparatus 1, for detecting changes in electric potential, an ambient humidity sensor, a head surface temperature sensor, and the like, according to the actual requirements. Conversely, it is also possible to dispense with some of the sensors.

The driving block 270 includes a display driver 271, a head driver 272, and a motor driver 273. The display driver 271 drives the display 4 of the operating block 11 in response to control signals delivered from the control block 200, i.e. in accordance with commands carried by the signals. Similarly, the head driver 272 drives the print head 7 of the printer block 12 in accordance with commands from the control block 200. Further, the motor driver 273 has a TF motor driver 273*a* for driving the TF motor 121 of the printer block 12, a CR motor driver 273*b* for driving the CR motor 122, a pump motor driver 273*c* for driving the pump motor 123, and a cutter motor driver 273*d* for driving the cutter motor 131 of the cutter block 13, and these drivers also drive the respective motors in accordance with commands from the control block 200, similarly to the display driver 271 and the head driver 272.

The operating block 11 includes the keyboard 3 and the display 4. The display 4 has a display screen 41 which is capable of displaying display image data of 96×64 dots on a rectangular display area of approximately 6 cm in the horizontal direction (X direction)×4 cm in the vertical direction (Y direction). The display 4 is used by the user to enter data via the keyboard 3 to form or edit matrix data indicative of a character string image having characters, such as letters, numerals, symbols, graphics and the like (represented by "letters" in the following description), arranged therein and a print image including the letter string image, view the resulting data, and enter various commands including ones for selecting menu options via the keyboard 3.

On the keyboard 3, there are arranged a letter key group 31 including an alphabet key group, not shown, a symbol key group, not shown, a number key group, not shown, and a nonstandard character key group, not shown, for calling nonstandard characters for selection, as well as a function key group 32 for designating various operation modes. In a type of the apparatus 1 which is capable of entering the Japanese language, there is also provided a kana key group, not shown, for entering Japanese hiragana letters and Japanese katakana letters.

The function key group 32 includes a power key, not shown, a print key, not shown, for instructing a printing operation, a form key, not shown, for displaying selection screens for switching between various operating modes, such as letter size-related modes, decorations-related modes, etc. as well as between various forms, a selection key, not shown, for finally determining entry of letter data and starting new lines during text entry as well as determining selection of one of the various operating modes on a corresponding one of the selection screens, a color specification key, not shown, for specifying printing colors including neutral colors (mixed colors) of print image data, a color-setting key, not shown, for setting colors of letters and background colors, and four cursor keys (up arrow key, down arrow key, left arrow key, and right arrow key), not shown, for moving the cursor or the display range of print image data on the display screen 41 in respective upward, downward, leftward, and rightward directions.

The function key group 32 also includes a cancel key, not shown, for canceling instructions, a shift key, not shown, for use in changing roles of respective keys as well as modifying registered image data, an image key, not shown, for alternately switching between a text entry screen or a selection screen and a display screen (image screen) for displaying print image data, a proportion-changing (zoom) key, not shown, for changing a proportion between the size of print image data and the size of display image data displayed on the image screen, and the cutting key for manually cutting the tape T.

Similarly to keyboards of the general type, the above key entries may be made by separate keys exclusively provided for respective key entries and/or by a smaller number of keys operated in combination with the shift key or the like. Here, for purposes of ease of understanding, the following description will be made assuming that there are provided as many keys as described above.

As shown in FIG. 2, from the keyboard 3, various commands described above and data are input to the control block 200.

The control block 200 includes a CPU 210, a ROM 220, a character generator ROM (hereinafter referred to as "the CG-ROM") 230, a RAM 240, and a peripheral control circuit (hereinafter referred to as the "P-CON") 250, all of which are connected to each other by an internal bus 260.

The ROM 220 includes a control program memory area 221 storing control programs executed by the CPU 210 and control data memory area 222 storing control data including a color conversion table, a letter modification table, a printing control condition-setting table, dither matrices, predetermined basic (regular) dither masks, and so forth. In the type of the apparatus 1 which is capable of entering the Japanese language, there is also provided a conversion table for converting Japanese hiragana letters into corresponding Japanese kanji letters. The CG-ROM 230 stores font data of letters or the like provided for the tape printing apparatus 1, and outputs corresponding font data when code data identifying a letter is given thereto.

The RAM 240 is supplied with backup power such that stored data items can be preserved even when the power is turned of f by operating the power key. The RAM 240 includes areas of a register group 241, a text data area 242 for storing text data of letters or the like entered by the user via the keyboard 3, a displayed image data area 243 for storing image data representative of an image displayed on the display screen 41, a print image data area 244 for storing print image data representative of a print image, a registered image data area 245 for storing registered image data items representative of registered images, a dither mask area 246 for storing a dither mask in use or after use, a color palette data area 247 for storing color palette information concerning printing colors and the like, and various buffer areas 248, such as a letter-forming buffer (font color buffer), a color conversion buffer, a basic color-by-basic color arranging buffer, and a print buffer. The RAM 240 is used as work areas for carrying out the control process.

The P-CON 250 incorporates a logic circuit for complementing the functions of the CPU 210 as well as dealing with interface signals for interfacing between the CPU 210 and peripheral circuits. The logic circuit is implemented by a gate array, a custom LSI and the like. For instance, a timer (TIM) 251 is incorporated in the P-CON 250 for the function of measuring elapsed time. Accordingly, the P-CON 250 is connected to the sensors of the sensor block 14 and the keyboard 3, for receiving the above-mentioned signals generated by the sensor block 14 as well as commands and data entered via the keyboard 3, and inputting these to the internal bus 260 directly or after processing them. Further, the P-CON 250 cooperates with the CPU 210 to output data and control signals input to the internal bus 260 by the CPU 210 or the like, to the driving block 270 directly or after processing them.

The CPU 210 of the control block 200 receives the various signals/data items, etc. from the respective blocks within the tape printing apparatus 1 via the P-CON 250, according to the control program read from the ROM 220, processes font data from the CG-ROM 230 and various data stored in the RAM 240, and delivers various signals/data items, etc. to the respective blocks within the apparatus 1 via the P-CON 250, to thereby carry out position control during printing operations, display control of the display screen 41, and print control that causes the print head 7 to carry out printing on the tape T under predetermined printing conditions. In short, the CPU 210 controls the overall operation of the tape printing apparatus 1.

Next, the overall control process carried out by the tape printing apparatus 1 will be described with reference to FIG. 5. As shown in the figure, when a program for carrying out the control process is started, e.g. when the power of the tape printing apparatus 1 is turned on by operating the power key, first, at step S1, initialization of the system including restoration of saved control flags is carried out to restore the tape printing apparatus 1 to the state it was in before the power was turned off the last time. Then, the image that was displayed on the display screen 41 before the power was turned off the last time is shown as an initial screen at step S2.

Figure 5:
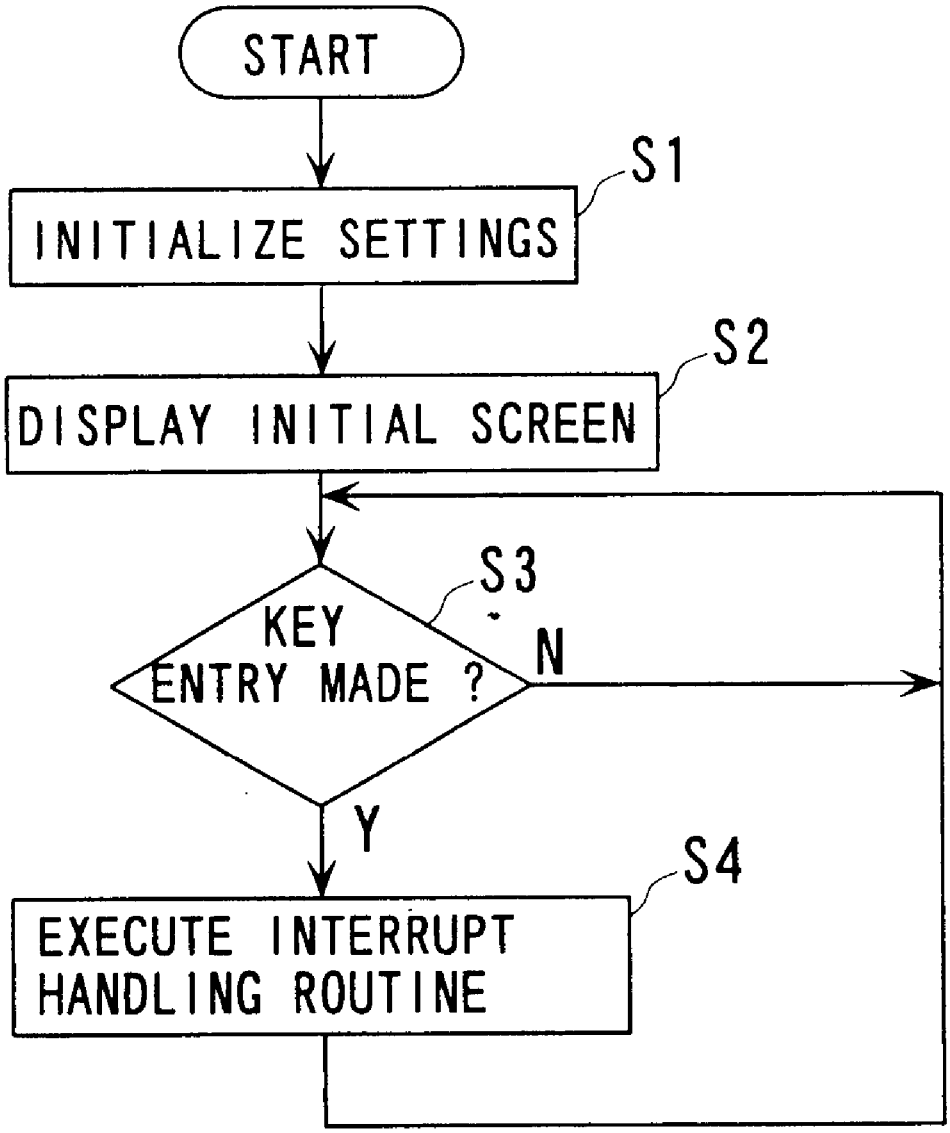
FIG. 5 is a flowchart showing a conceptual representation of an overall control process executed by the FIG. 1 tape printing apparatus.

The following steps in FIG. 5, that is, step S3 for determining whether or not a key entry has been made and step S4 for carrying out an interrupt handling routine are conceptual representations of actual operations. Actually, when the initial screen has been displayed at step S2, the tape printing apparatus 1 enables an interrupt by key entry (keyboard interrupt), and maintains the key entry wait state (No to S3) until a keyboard interrupt is generated. When the keyboard interrupt is generated (Yes to S3), a corresponding interrupt handling routine is executed at step S4, and after the interrupt handling routine is terminated, the key entry wait state is again enabled and maintained (No to S3).

As described above, in the tape printing apparatus 1, main processing operations by the apparatus are carried out by interrupt handling routines, and hence if print image data for printing is provided or has been prepared, the user can print the image data at a desired time, by depressing the print key to thereby generate an interrupt and start a printing process.

Figure 6:
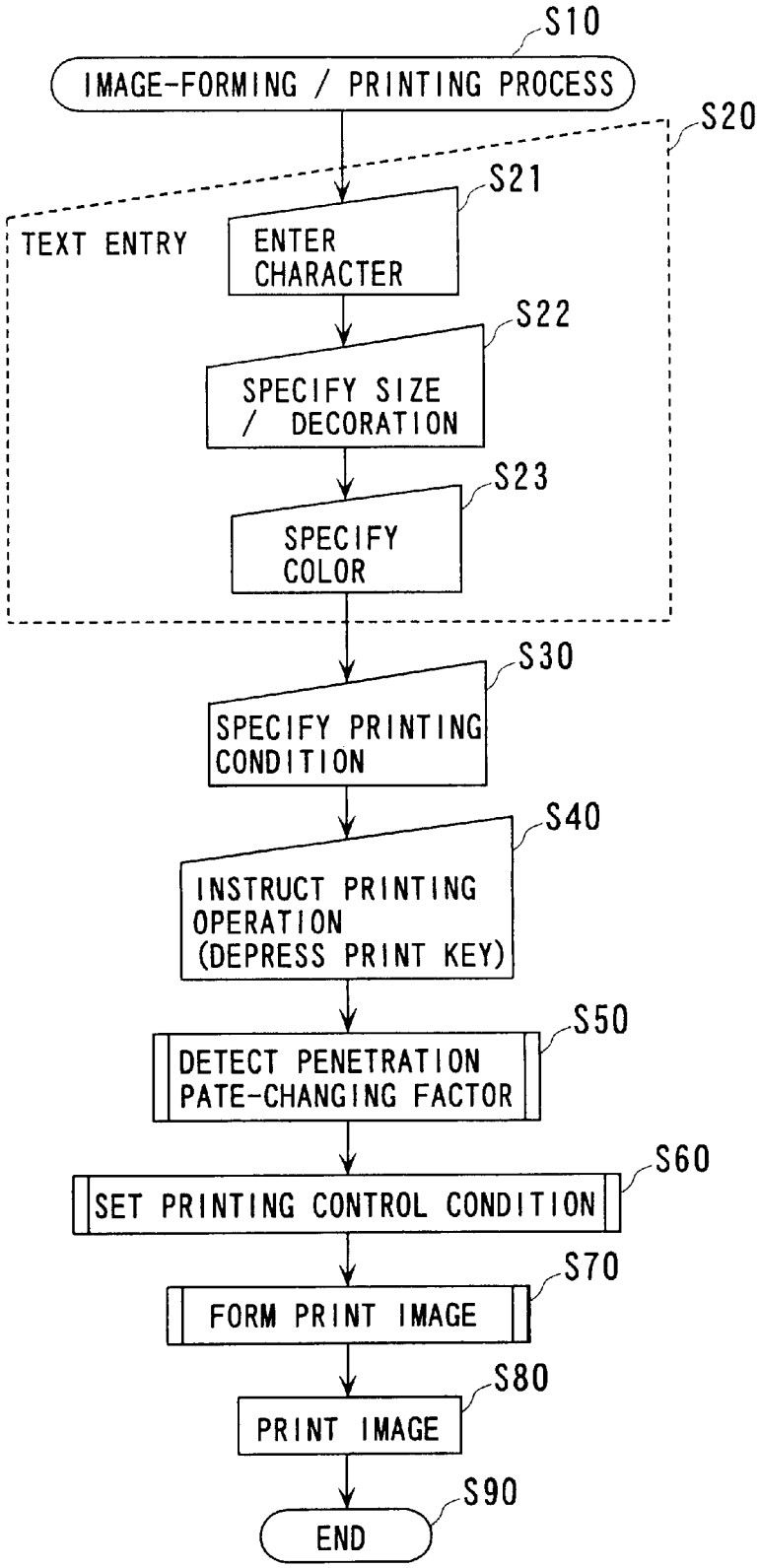
FIG. 6 is a flowchart showing an example of a typical image-forming/printing process.

FIG. 6 shows a flowchart of a routine for a typical image-forming/printing process executed by the tape printing apparatus 1. First, in this process (S10), as shown in the figure, text data of letters or the like is entered into the text data area 242 at step S20. More specifically, at step S21, the user enters letters, such as a letter string "123", by the keyboard 3 while confirming or viewing the results of the entry on the display 4. Then, a size and a decoration of the letters are specified at step S22, followed by color specification, etc. being carried out at step S23. To specify the size or the decoration, the form key is depressed to display a selection screen on the display screen 41 of the display 4, and the cursor keys are operated in this state to select a desired one of options displayed on the screen. Then, the selection key is depressed to finally determine the desired size or decoration. On the other hand, to specify a color, gradation values or gray levels of C (cyan), M (magenta), and Y (yellow) are designated on the display screen 41 by depressing the color specification key, based on color information (color pallet information) defined by a color conversion table, and colors of letters and their background are designated and set by depressing the color-setting key.

In the tape printing apparatus 1, another option which can be selected by displaying a selection screen by depressing the form key and highlighting it through operation of the cursor keys is one for designating a printing condition. When the option is selected, an option of "MORE CLEARLY" or "FASTER" can be selected at a menu screen immediately under the hierarchical level of the selected option. More specifically, the option "MORE CLEARLY" is provided for designating improvement in the quality of a print image, while the option "FASTER" is provided for designating improvement in printing speed in a printing operation. Further, if neither of these options are selected, the optimum printing is designated in which default values or printing control conditions designated most frequently in the past are used for predetermined ones suitable for a moderate image quality and a moderate printing speed. Although to adjust the balance between the image quality and the printing speed, it is only required that one of at least two or preferably first two of the above options is designated, the apparatus according to the present embodiment is configured such that one of the three options can be selected in consideration of the operability of the apparatus.

Depending on the penetration rate of ink into the tape (printing object) T, if further drying of ink is awaited after completion of printing of desired print dots at the cost of a printing speed and then adjacent print dots are printed, it is sometimes possible to improve the quality of a printed image, e.g. by increasing the print density. Inversely, there can be a case where a print image is desired to be printed as fast as possible on condition that the minimum quality of the print image is maintained. In the tape printing apparatus 1, one of these printing conditions is designated, and printing control conditions are set according to the designated printing condition and results of detection of factors causing the change in the penetration rate, so that the image quality and the printing speed can be enhanced to the allowable extent as desired by the user. This makes it easy to print a print image of a desired quality at a desired speed, thereby increasing the operability and capability of the apparatus in image printing.

In this embodiment, a typical one of possible variations of designation of improvement in the image quality designated by the option "MORE CLEARLY" is designation of printing a print image of the possible highest quality. Now the phase "designation of improvement in image quality" is used to include designation of printing of a print image with preference or priority to image quality. In the case of top priority to image quality, however, an option "MOST CLEARLY" for designating the top priority of image quality may be provided in addition to the option "MORE CLEARLY". Similarly, a typical one of possible variations of designation of improvement in printing speed designated by the option "FASTER" is designation of printing a print image at the maximum allowable printing speed while maintaining the minimum quality of the print image. Now the phase "designation of improvement in printing speed" is used to include designation of printing of a print image with preference or priority to a printing speed. In the case of top priority to printing speed, an option "FASTEST" for designating the top priority of printing speed may be provided in addition to the option "FASTER". Actually, in the tape printing apparatus 1 according to the present embodiment, numerical values are provided for designating minutely-defined ranks ranging from the top priority of the image quality to the top priority of printing speed. When the option "MORE CLEARLY" is designated, a numerical value is selected which is one rank closer to the top priority of image quality than the present numerical value. Inversely, when the option "FASTER" is designated, a numerical value is selected which is one rank closer to the top priority of printing speed than the present numerical value.

As shown in FIG. 6, when the text entry of the letter string "123" or the like and the designation of printing conditions are completed at steps S20 and S30, respectively, and a printing operation is instructed at step S40, factors causing a change in the penetration rate, described hereinafter, are detected at step S50 and the printing control conditions are set at step S60. Thereafter, each letter of the letter string "123" is formed based on an outline font stored in the CG-ROM 230, for instance, whereby print image data representative of a print image is formed at step S70. A general type of image can be represented by image data e.g. of a binary matrix (dot matrix) composed of two-valued (binary) matrix elements, with "1" assigned to matrix elements corresponding to respective valid pixels which are to be printed and "0" assigned to matrix elements corresponding to respective invalid pixels which are not to be printed, and in the apparatus 1, actual image processing is performed on the image data. More specifically, a print image is realized only when it is printed based on corresponding print image data. In the following description, however, e.g. an expression a print image is formed" is used for brevity in place of "print image data representative of a print image is formed". Thus, the print image is formed at the step S70 and printed at step S80, followed by terminating the image-forming/printing process at step S90.

Although in the description of the above-mentioned example, the factors causing a change in the penetration rate are detected at the step S50 after instruction of a printing operation (S40), this is not limitative, but some of the factors causing the change in the penetration rate can be detected before the printing is instructed, as described herein below, and such factors may be detected before the instruction. Further, the print image may be formed in advance before the printing is instructed, and modified or adjusted during the image printing process (S80) only when the print image is required to be modified (or adjusted) under the printing control conditions. In the case of the present embodiment, the printing control condition-setting process (S60) is carried out based on results of detection of factors causing a change in the penetration rate with reference to the printing control condition-setting table stored in the control data memory area 222 of the ROM 220.

The factors causing the change in the penetration rate (penetration rate-changing factors) include a type of the tape (printing object) T. Accordingly, in the FIG. 6 process for detecting the penetration rate-changing factors (S50), the type of the tape T, that is, the material and the width (size) of the tape T, whether or not the tape T is laminated with the laminating tape T2 are detected by using the tape-discriminating sensor 141 described above with reference to FIG. 2. As described hereinbefore, even when each ink droplet is ejected to the center of a corresponding print dot, the size and density of each print dot depend on the degree of penetration (penetration rate) of ink into the tape T, so that a printed image is sometimes prevented from having a desired image quality, even if printing control conditions, such as a print density and the like, are set to predetermined setting values. To solve the problem, in the tape printing apparatus 1, the type of the tape T is detected as one of the factors causing a change in the penetration rate, and hence it is possible to determine the difference in the penetration rate of ink into the tape T dependent on the type of the tape T. When the penetration rate has changed from a value initially set or a value set the last time, a change in the penetration rate can be detected. This makes it possible to set printing control conditions, such as a print density and the like, according to the change in the penetration rate, whereby the quality of a print image printed by using ink can be maintained, even if the penetration rate has changed.

In this embodiment, the type of the tape T include a material thereof, as described above. Generally, if printing objects are different in material, the penetration rate of ink is different between the printing objects, even if the ink itself is identical. In the tape printing apparatus 1, since the items to be detected as to the type of the tape (printing object) T include the material of the tape T. the change in the penetration rate due to a difference in material between the tapes T can be detected, whereby printing control conditions, such as a print density and the like, can be set according to the change in the penetration rate.

More specifically, if the penetration rate has changed due to a change in the penetration rate-changing factor, that is, a difference in material of tapes T, it is possible to set printing control conditions (print density, rotational speed (CR speed) of the CR motor 122, rotational speed (TF speed) of the TF motor 121 and color gradation value for each of four colors C, M, Y, and K, for a change in material of the tape T according to the change in the penetration rate. As a result, even when the penetration rate of ink into the tape (printing object) T has changed, the quality of a print image printed by using the ink can be maintained.

Further, in this embodiment, the items to be detected as to the type of the tape T include a width (size) of the tape (printing object), as described above. In general, if printing objects are different in size from each other, a print unit to be printed on one printing object, such as one dot line of print dots and the like, takes a different printing time from a print unit to be printed on another printing object, so that the drying time which ejected ink takes to become dry can vary with the printing object, that is, depending on the difference in time elapsed between printing of a print unit (line of print dots) and printing of the following print unit (line of print dots) on each printing object. This sometimes changes a penetration rate of ink into the printing object before the ink becomes dry. This also can change the print density and the printing speed which enable a print image to be printed with the quality thereof being maintained. In the tape printing apparatus 1, the items to be detected as to the type of the tape (printing object) T include the width (size) of the tape T. Hence, it is possible to detect the change in the penetration rate of ink into a printing object before the ink becomes dry. This makes it possible to set printing control conditions (print density, CR speed, TF speed and the like, for a change in size) according to the change in the penetration rate.

Further, the penetration rate-changing factors include a condition of whether or not the tape T is laminated with the laminating tape T2. Generally,when a printed image is laminated with a laminating material, the image is protected by the lamination. On the other hand, since ink is made far more difficult to become dry than before the lamination, the drying time of the ink changes, whereby the penetration rate can be changed at which the ink penetrates into the tape T before the ink becomes dry. This also can change the print density and the printing speed which permits a print image to be printed while preserving the quality thereof. Further, when the lamination is carried out for an image printed by using the ink before the ink becomes dry, the ink can be exuded to adversely affect the following print image due to a change in the penetration rate and adheres to a laminating device or mechanism, so that it is required to laminate the printed image when the ink is sufficiently dry after being ejected for printing.

To solve the problem, in the tape printing apparatus 1, the penetration rate-changing factors to be detected include a condition of whether or not a printing object is to be laminated with a transparent laminating material. When it is detected that the lamination is to be carried out, the printing object is laminated with the transparent laminating material such that the laminating material covers an image printed on the printing object. That is, it is possible to determine a change in the penetration rate of ink into the tape (printing object) T, which is dependent on whether or not the lamination is carried out, and detect the changed penetration rate. Accordingly, it is possible to set printing control conditions (print density, CR speed, TF speed and the like for the condition of whether or not the lamination is executed) according to the change in the penetration rate. As a result, even when the penetration rate of ink into the tape T has changed, the quality of a print image printed by using the ink can be maintained. In this embodiment, the execution or non-execution of the lamination corresponds to a type of the printing object, detection of whether or not the lamination is to be carried out may be effected as part of detection of the tape (printing object) T. It should be noted that when an arbitrary tape (printing object) T can be laminated with a transparent laminating material, the apparatus may be configured such that the user can set whether or not the lamination is executed and results of these settings are detected.

Further, the penetration rate-changing factors to be detected include an ambient temperature. Therefore, in the FIG. 6 process for detecting penetration rate-changing factors (S50), an ambient temperature is detected by the ambient temperature sensor 143. In general, if the ambient temperature has changed, a drying time of ink also changes, which can change the penetration rate at which the ink penetrates into the tape T before the ink becomes dry. In the tape printing apparatus 1, the ambient temperature is detected as one of the penetration rate-changing factors, so that it is possible to discriminate between different penetration rates caused by different ambient temperatures, and thereby detect a change in the penetration rate. This makes it possible to set printing control conditions (print density, CR speed, TF speed and the like for an ambient temperature) according to the change in the penetration rate. As a result, even if the penetration rate of ink into the tape T has changed, the quality of a print image printed by using the ink can be maintained. Further, similarly to the ambient temperature, ambient humidity serves as one of the penetration rate-changing factors, and hence, as described above with reference to FIG. 2, the apparatus may be provided with an ambient humidity sensor such that the ambient humidity is detected in place of ambient temperatures or in combination therewith for combined use.

Further, the penetration rate-changing factors to be detected include the number of print dots (cumulative number of print dots) existing in a predetermined unit print area in which a print image has already been printed. Therefore, in the FIG. 6 process for detecting penetration rate-changing factors (S50), the number of print dots (cumulative number of print dots) which will exist every predetermined number of lines as the predetermined unit print area, that is, which will exist in the predetermined unit print area in which a print image has already been printed, is detected based on data as a source of the print image, such as text data of e.g. the above-mentioned letter string "123". As described above with reference to FIG. 6, it is also possible to form a print image before printing thereof is instructed. In such a case, the cumulative number of print dots of the print image may be detected e.g. by directly counting pixels (valid pixels) to be printed based on print image data representative of the print image. Further, in the FIG. 6 image printing process (S80), the cumulative number of print dots may be counted when the print image is actually printed, so as to feed back the resulting value as a printing control condition.

Generally, if the number of print dots existing in a predetermined unit print area varies, the drying time of ink also varies even if the ink is identical, which can change the penetration rate at which the ink penetrates into the tape T before the ink becomes dry. In the tape printing apparatus 1, the cumulative number of print dots is detected, whereby the change in the penetration rate of ink in use can be detected. This makes it possible to set printing control conditions (print density, CR speed, TF speed and the like for the cumulative number of print dots) according to the change in the penetration rate. As a result, even if the penetration rate of ink into the tape T has changed, the quality of a print image printed by using the ink can be maintained.

On the other hand, the printing control conditions include a print density which is inversely proportional to the distance between the centers of print dots in a print image, which are adjacent to each other in the direction of printing. That is, as described hereinabove, if the penetration rate of ink into the tape (printing object) T has changed, print dots adjacent to each other can be mixed with each other or inversely, limited spreading of ink increases space between the print dots, which results in degraded quality of the print image. To solve the problem, in the tape printing apparatus 1, the above print density, which is inversely proportional to the distance between the centers of print dots adjacent to each other in a print image, is included in the printing control conditions set in the FIG. 6 printing control condition-setting process (S60), so that a print density can be set according to the change in the penetration rate. As a result, even if the penetration rate of ink into the tape T has changed, the quality of a print image printed by using the ink can be maintained.

In the tape printing apparatus 1, as described with reference to FIGS. 1 to 4, the TF motor 121 is driven to feed the tape T as a printing object toward the tape exit 22 (in the direction of feed of the tape T), while the CR motor 122 is driven to move the print head 7 in a direction (direction of the width of the tape T) orthogonal to the direction of feed of the tape T, thereby carrying out a printing operation. In short, the tape T and the print head 7 are relatively moved by the TF motor 121 in the direction of feed of the tape T, and at the same time they are relatively moved in the direction of the width of the tape T, orthogonal to the direction of feed of the tape T.

Generally, if a time period (drying time) over which ink of print dots becomes dry changes, the penetration rate of the ink before the ink becomes dry changes. If the penetration rate changes, the size of each print dot also changes. Therefore, when the penetration rate of ink into a printing object has changed, if a time period or a time interval from a printing operation for printing each arbitrary print dot to a printing operation for printing a corresponding print dot adjacent thereto is uniformly set to a predetermined value, that is, if the printing speed is uniformly set to a predetermined value, print dots adjacent to each other in the directions of printing (directions of relative movement) can be mixed with each other, thereby degrading the quality of a printed image. Inversely, if a drying time longer than required is secured, the printing speed is undesirably lowered.

To solve the problem, in the tape printing apparatus 1, the printing control conditions thereof include the speed of the relative movement. More specifically, they include the CR speed and the TF speed determining the speed of the relative movement. Of course, the corresponding printing control conditions may be defined by the speed of the relative movement. That is, the speed of the relative movement varying with the change in the penetration rate can be set as a printing control condition, thereby making it possible to change the printing speed. Particularly, in the case of print dots in a print image, which are adjacent to each other in the direction of the width of the tape T, the adjacent or following print dots are printed immediately after the preceding ones are printed. Hence, the CR speed, which directly affects the drying time of the print dots just printed and timing of printing of the adjacent print dots, affects the quality of the print image more seriously than the TF speed. In the tape printing apparatus 1, however, both of the CR speed and the TF speed can be set as respective printing control conditions, whereby the printing speed can be changed. As a result, it is possible to set a printing speed at which a minimum drying time can be secured for maintaining the quality of the print image. There fore, even if the penetration rate of ink into the tape (printing object) T has changed, the quality of a print image printed by using the ink can be maintained. Further, since the print image can be printed at a suitable printing speed in manner varying with the change in the penetration rate, it is possible to prevent undesired lowering of the printing speed (increase in the printing time).

In the tape printing apparatus 1, the TF motor 121 and the CR motor 122 are implemented by pulse motors. More specifically, predetermined step pulses are output from the motor driver 273 of the driving block 270 described above with reference to FIG. 2, and the TF motor 121 and the CR motor 122 are driven for rotation in the number of the pulses (the number of the steps) to thereby control the CR speed and the TF speed. Therefore, the CR speed and the TF speed as the above printing control conditions include in its meaning a predetermined number of these pulses. Of course, the corresponding printing control conditions may be literally defined by the numbers of pulses of the CR speed and the TF speed.

As described above, in the tape printing apparatus 1, when the CR speed and the TF speed are set as printing control conditions, the number of pulses to be actually delivered is determined, and the pulses are delivered in the determined number to control the CR speed and the TF speed. The number of pulses for controlling the TF speed changes according to the type (particularly material) of the tape T, even for an identical setting of the TF speed. Generally, slippage of a printing object varies with the printing object. When the printing object is fed in response to each pulse of a unit feed signal, by a unit distance varying with the slippage of the printing object, if it is desired to feed the object at. a predetermined printing speed, it is required to output a corresponding number of pulses of the unit feed signal dependent on the slippage of the printing object. Inversely, it is possible to change the printing speed by changing the number of pulses of the unit feed signal. Therefore, in the tape printing apparatus 1, when the TF speed is set as a printing control condition, the number of pulses for feeding the tape T by the unit distance is changed as a printing control condition at the lower level of settings in hierarchy, according to the type of the tape T as the printing condition for printing the tape T (the modified number of pulses is set).

More specifically, in the tape printing apparatus 1, it is possible to set the number of pulses of the unit feed signal as a printing control condition dependent on a printing condition (i.e. change in the penetration rate due to any of the penetration rate-changing factors), thereby changing the TF speed (printing speed). Accordingly, by controlling the TF speed (relative speed in the direction of feed of the tape T), similarly to the case of the control of the CR speed (relative speed in the direction of the width of the tape T), it is possible to print a print image at a suitable printing speed in a manner varying with the change in the penetration rate. Hence, a minimum drying time required for maintaining the quality of a print image can be secured, even when the penetration rate of ink into the tape (printing object) Thas changed, which makes it possible to maintain the quality of the print image printed by using the ink and prevent undesired reduction of a printing speed (increase in the printing time).

Further, the printing control conditions set in the FIG. 6 printing control condition-setting process (S60) include the gradation value of each pixel of a print image to be printed. For instance, when the print image is a monochrome image, gradation values thereof representative of gray tones of its pixels can be set as a printing control condition, or when the print image is a color image, gradation values thereof representative of colors of its pixels can be set as a printing control condition. Therefore, gradation values of pixels can be set in dependence on the change in the penetration rate, whereby even when the penetration rate of ink into the tape (printing object) T has changed, it is possible to maintain the quality of the print image printed by using the ink.

In the tape printing apparatus 1, when the print image is a color image, the gradation values include a plurality of basic color gradation values as the gradation values of a plurality of basic colors, and (one or more kinds of) inks used thereby include inks for printing the plurality of basic colors as respective printing colors. The plurality of basic colors include three primary colors and further include a basic color corresponding to a mixed color of the three primary colors.

In general, a color or color tone of each pixel of a color image can be represented by decomposing the color into basic color gradation values of the plurality of basic colors. As described above, in the tape printing apparatus 1, when a print image is a color image, the gradation values include a plurality of basic color gradation values as the gradation values of a plurality of basic colors, and the inks used by the apparatus 1 include inks for printing the plurality of basic colors as respective printing colors. Hence, it is possible to print the print image as a color image by using inks for printing the basic colors as printing colors and printing the print image according to the basic color gradation values. Further, since the plurality of basic colors include three primary colors, the color of each pixel of the color image can be represented by decomposing the color into basic color (primary color) gradation values of the three primary colors. Further, in this case, the inks include inks for printing the three primary colors as printing colors, so that it is possible to print the print image as a color image by using the inks according to the basic color gradation values. It should be noted that in this case, C (cyan), M (magenta) and Y (yellow) are employed as the three primary colors, and that various tones of colors are expressed by a so-called subtractive color mixing method.

Further, since the plurality of basic colors further include a basic color corresponding to a mixed color of the three primary colors, the inks in use further include an ink for printing a basic color corresponding to the mixed color of the three primary colors. More specifically, although the mixture of C (cyan), M (magenta) and Y (yellow) as the three primary colors provides K (black), the use of an ink of K (black) makes it possible to obtain a more beautiful tone of black color than the use of the K (black) formed by mixing the primary colors. Therefore, the tape printing apparatus 1 is capable of printing beautiful print images by using the four (basic) colors.

As described hereinabove, in the tape printing apparatus 1, the factors causing the change in the penetration rate of (one or more types of) inks of the four colors C, M, Y and K into the tape (printing object) T are detected, and (one or more) printing control conditions are set according to results of the detection, whereby a print image is printed on the tape T by using the inks of the four colors C, M, Y and K, based on print image data representative of the print image and the printing control conditions. That is, it is possible to know in advance a change in the penetration rate of ink by detecting the factors causing a change in the penetration rate and set printing control conditions according to results of the detection. Accordingly, even when the penetration rate has changed, suitable printing control conditions can be set according to the change in the penetration rate, and a print image can be printed according to the conditions set, so that even if the penetration rate has changed, it is possible to maintain the quality of the print image printed by using the inks.

Although in the above embodiment, the invention is applied to the tape printing apparatus 1 of an ink jet type by way of example, this is not limitative, but the image printing method and device according to the invention can be applied to an image printing device for a printing apparatus of the general type, such as a dot impact type employing a ribbon containing ink, a thermal type, and the like, or an apparatus other than the printing apparatus, so long as the image printing device prints a print image on a printing object by using one or more inks.

It is further understood by those skilled in the art that the foregoing is a preferred embodiment of the invention, and that various changes and modifications may be made without departing from the spirit and scope thereof.

What is claimed is:

1. A method of printing a print image on a printing object by using ink, comprising the steps of:

detecting factors causing a change in a penetration rate of at least one kind of ink into said printing object;

setting printing control conditions in dependence on results of detection of said factors causing said change in said penetration rate; and printing said print image on said printing object by using said at least one kind of ink based on print image data representative of said print image and said printing control conditions; and wherein said factors causing said change in said penetration rate include a condition of whether a transparent laminating material is laminated onto said printing object; and the method further includes the steps of:

detenrinig whether said transparent laminating material is to be laminated onto said printing object; and laminating said transparent laminating material onto said printing object such that said transparent laminating material covers said print image printed on said printing object, when it is determined that said transparent laminating material is to be laminated onto said printing object.

2. A method according to claim 1, wherein the step of printing said print image includes printing said print image while causing relative movement of at least one of a print head that ejects droplets of said ink and said printing object relative to each other, and wherein said printing control conditions include a speed of said relative movement.

3. A method according to claim 1, wherein the step of printing said print image includes the steps of:

feeding said printing object by a unit distance dependent on a slippage of said printing object in response to each pulse of a predetermined unit feed signal, and carrying out printing on said printing object being fed, and wherein said printing control conditions include the number of pulses of said predetermined unit feed signal generated per unit time period.

4. A method according to claim 1, wherein said printing control conditions include a gradation value of each pixel of said print image.

5. A method according to claim 4, wherein said print image is a color image, wherein said gradation value comprises a plurality of basic color gradation values corresponding to respective basic colors, and wherein said at least one kind of ink includes inks for printing said plurality of basic colors as respective print colors.

6. A method according to claim 4, wherein said plurality of basic colors include three primary colors.

7. A method according to claim 6, wherein said plurality of basic colors further include a basic color corresponding to a mixed color of said three primary colors.

8. A method according to claim 1, further including the step of designating a printing mode out of at least two of an image quality-preference mode for printing said print image with a higher image quality, a printing speed-preference mode for printing said print image with a faster printing speed, and an optimal print mode for printing said print image with a moderate image quality and a moderate printing speed, and wherein the step of setting printing control conditions includes setting said printing control conditions according to the designated printing mode, in dependence on results of detection of said factors causing said change in said penetration rate.

9. A method according to claim 1, wherein said factors causing said change in said penetration rate include a type of said printing object.

10. A method according to claim 9, wherein said type of said printing object includes a material of said printing object.

11. A method according to claim 9, wherein said type of said printing object includes a size of said printing object.

12. A method according to claim 1, wherein said factors causing said change in said penetration rate include at least one of ambient temperature and ambient humidity.

13. A method according to claim 1, wherein said factors causing said change in said penetration rate include the cumulative number of print dots detected in a predetermined unit printing area on which printing has already been carried out.

14. A method according to claim 1, wherein said printing object is a tape.

15. A method according to claim 1, wherein said print image is printed by an ink jet printing method.

16. A method according to claim 1, wherein the step of setting printing control conditions is carried out based on the results of detection of factors causing a change in said penetration rate with reference to a printing control condition-setting table.

17. A method according to claim 1, wherein said printing control conditions include a print density which is inversely proportional to a distance between centers of adjacent print dots of said print image.

18. An image printing device comprising;

a penetration rate-changing factor-detecting section for detecting factors causing a change in a penetration rate of at least one kind of ink into a printing object;

a printing control condition-setting section for setting printing control conditions in dependence on results of detection of said factors causing said change in said penetration rate; and an image printing section for printing said print image on said printing object by using said at least one kind of ink based on print image data representative of said print image and said printing control conditions; and wherein said factors causing said change in said penetration rate include a condition of whether a transparent laminating material is laminated onto said printing object; and the image printing device further includes:

a lamination-determining section for determining whether said transparent laminating material is to be laminated onto said printing object; and a laminating section for laminating said transparent laminating material onto said printing object such that said transparent laminating material covers said print image printed on said printing object, when it is determined that said transparent laminating material is to be laminated onto said printing object.

19. An image printing device according to claim 18, wherein said image printing section includes:

a print head that ejects droplets of said ink, and a relative movement section for causing relative movement of at least one, of said print head and said printing object relative to each other, and wherein said printing control conditions include a speed of said relative movement.

20. An image printing device according to claim 18, wherein said image printing section includes:

a signal generating section that generates a predetermined unit feed signal;

a printing object feeding section that feeds said printing object by a unit distance dependent on a slippage of said printing object in response to each pulse of said predetermined unit feed signal; and a printing executing section for carrying out printing of said print image on said printing object being fed, and wherein said printing control conditions include the number of pulses of said predetermined unit feed signal generated per unit time period.

21. An image printing device according to claim 18, wherein said printing control conditions include a gradation value of each pixel of said print image.

22. An image printing device according to claim 21, wherein said print image is a color image, wherein said gradation value comprises a plurality of basic color gradation values corresponding to respective basic colors, and wherein said at least one kind of ink includes inks for printing said plurality of basic colors as respective print colors.

23. An image printing device according to claim 21, wherein said plurality of basic colors include three primary colors.

24. An image printing device according to claim 23, wherein said plurality of basic colors further include a basic color corresponding to a mixed color of said three primary colors.

25. An image printing device according to claim 18, further including a printing mode-designating section for designating a printing mode out of at least two of an image quality-preference mode for printing said print image with a higher image quality, a printing speed-preference mode for printing said print image with a faster printing speed, and an optimal print mode for printing said print image with a moderate image quality and a moderate printing speed, and wherein said printing control condition-setting section sets said printing control conditions according to the designated printing mode, in dependence on results of detection of said factors causing said change in said penetration rate.

26. An image printing device according to claim 18, wherein said factors causing said change in said penetration rate include a type of said printing object.

27. An image printing device according to claim 26, wherein said type of said printing object includes a material of said printing object.

28. An image printing device according to claim 26, wherein said type of said printing object includes a size of said printing object.

29. An image printing device according to claim 18, wherein said factors causing said change in said penetration rate include at least one of ambient temperature and ambient humidity.

30. An image printing device according to claim 18, wherein said factor causing said change in said penetration rate include the cumulative number of print dots detected in a predetermined unit printing area on which printing has already been carried out.

31. An image printing device according to claim 18, wherein said printing object is a tape.

32. An image printing device according to claim 18, wherein said print image is printed by an ink jet printing method.

33. An image printing device according to claim 18, wherein said printing control condition-setting section sets printing control conditions based on the results of detection of factors causing a change in said penetration rate with reference to a printing control condition-setting table.

34. An image printing device according to claim 18, wherein said printing control conditions include a print density which is inversely proportional to a distance between centers of adjacent print dots of said print image.

* * * * *